US010480367B2

(12) United States Patent
Seok et al.

(10) Patent No.: US 10,480,367 B2
(45) Date of Patent: Nov. 19, 2019

(54) HYDRAULIC CIRCUIT SYSTEM FOR FORCED REGENERATION OF DIESEL PARTICULATE FILTER

(71) Applicant: Doosan Infracore Co., Ltd., Incheon (KR)

(72) Inventors: Myoung Jin Seok, Gyeonggi-do (KR); Sung Hoon Lee, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 548 days.

(21) Appl. No.: 14/655,914

(22) PCT Filed: Dec. 3, 2013

(86) PCT No.: PCT/KR2013/011093
§ 371 (c)(1),
(2) Date: Jun. 26, 2015

(87) PCT Pub. No.: WO2014/104603
PCT Pub. Date: Jul. 3, 2014

(65) Prior Publication Data

US 2015/0337705 A1 Nov. 26, 2015

(30) Foreign Application Priority Data

Dec. 26, 2012 (KR) ..... 10-2012-0152864

(51) Int. Cl.
*F01N 3/08* (2006.01)
*F04C 2/12* (2006.01)
(Continued)

(52) U.S. Cl.
CPC ..... *F01N 3/0821* (2013.01); *E02F 9/2066* (2013.01); *E02F 9/226* (2013.01);
(Continued)

(58) Field of Classification Search
CPC ..... E02F 9/2066; E02F 9/2235; E02F 9/226; E02F 9/2282; E02F 9/2296; F01N 3/0821;
(Continued)

(56) References Cited

U.S. PATENT DOCUMENTS 3,422,767 A * 1/1969 McAlvay ..... F04B 1/2078 91/505
5,974,796 A * 11/1999 Ishikawa ..... E02F 9/2225 60/399
(Continued)

FOREIGN PATENT DOCUMENTS

EP 2530266 A1 12/2012
JP 2010261340 A 11/2010
(Continued)

OTHER PUBLICATIONS

International Search Report and English Translation dated Mar. 12, 2014 for corresponding International Application No. PCT/KR2013/011093, 5 pages.
(Continued)

*Primary Examiner* — Patrick Hamo
*Assistant Examiner* — Joseph S. Herrmann
(74) *Attorney, Agent, or Firm* — Hauptman Ham, LLP

(57) ABSTRACT

The present disclosure relates to a hydraulic circuit system for forced regeneration of a diesel particulate filter, and more particularly, to a hydraulic circuit system for forced regeneration of a diesel particulate filter (DPF), which prevents a working machine from being operated when the diesel particulate filter is forcedly regenerated by combusting particulate matters (PM) in a case in which the diesel particulate filter is installed in a construction machine with a diesel engine and particulate matters contained in exhaust gas are collected in the diesel particulate filter.

4 Claims, 6 Drawing Sheets

(51) Int. Cl.

| | |
|---|---|
| ***F04C 14/24*** | (2006.01) |
| ***F04C 13/00*** | (2006.01) |
| ***F04C 15/00*** | (2006.01) |
| ***F04C 15/06*** | (2006.01) |
| ***F02D 29/04*** | (2006.01) |
| ***E02F 9/20*** | (2006.01) |
| ***E02F 9/22*** | (2006.01) |
| *F01N 9/00* | (2006.01) |

(52) U.S. Cl.

CPC ..... *E02F 9/2235* (2013.01); *E02F 9/2282* (2013.01); *E02F 9/2296* (2013.01); *F02D 29/04* (2013.01); *F04C 2/12* (2013.01); *F04C 13/005* (2013.01); *F04C 14/24* (2013.01); *F04C 15/008* (2013.01); *F04C 15/06* (2013.01); *F01N 9/002* (2013.01); *F15B 2211/20523* (2013.01); *F15B 2211/20546* (2013.01); *F15B 2211/275* (2013.01)

(58) Field of Classification Search

CPC .. F01N 9/002; F02D 29/04; F04C 2/12; F04C 13/005; F04C 14/24; F04C 15/008; F04C 15/06; F15B 2211/20523; F15B 2211/20546; F15B 2211/275

See application file for complete search history.

(56) References Cited

U.S. PATENT DOCUMENTS

| | | | | |
|---|---|---|---|---|
| 8,316,636 | B2 * | 11/2012 | Nakamura | B01D 53/90 60/277 |
| 2012/0000191 | A1 | 1/2012 | Hagiwara et al. | |
| 2012/0003069 | A1 | 1/2012 | Hagiwara et al. | |
| 2012/0163996 | A1 * | 6/2012 | Nakamura | F04B 49/08 417/34 |
| 2012/0186889 | A1 * | 7/2012 | Yoshida | E02F 3/325 180/65.265 |

FOREIGN PATENT DOCUMENTS

| | | | | |
|---|---|---|---|---|
| JP | 2011-112004 | A | 6/2011 | |
| JP | 2011-184988 | A | 9/2011 | |
| KR | 10-2011-0126169 | A | 11/2011 | |
| KR | 10-2011-0136864 | A | 12/2011 | |
| WO | 2011-162179 | A1 | 12/2011 | |
| WO | WO 2012055917 | A1 * | 5/2012 | E02F 9/2235 |
| WO | 2011093400 | A1 | 6/2013 | |

OTHER PUBLICATIONS

European Search Report dated Jul. 28, 2016 for European Application No. 13866930.1, 5 pages.

* cited by examiner (a) Normal Mode (b) Forced Regeneration Mode

<Prior Art>

<Prior Art>

【Fig. 4】
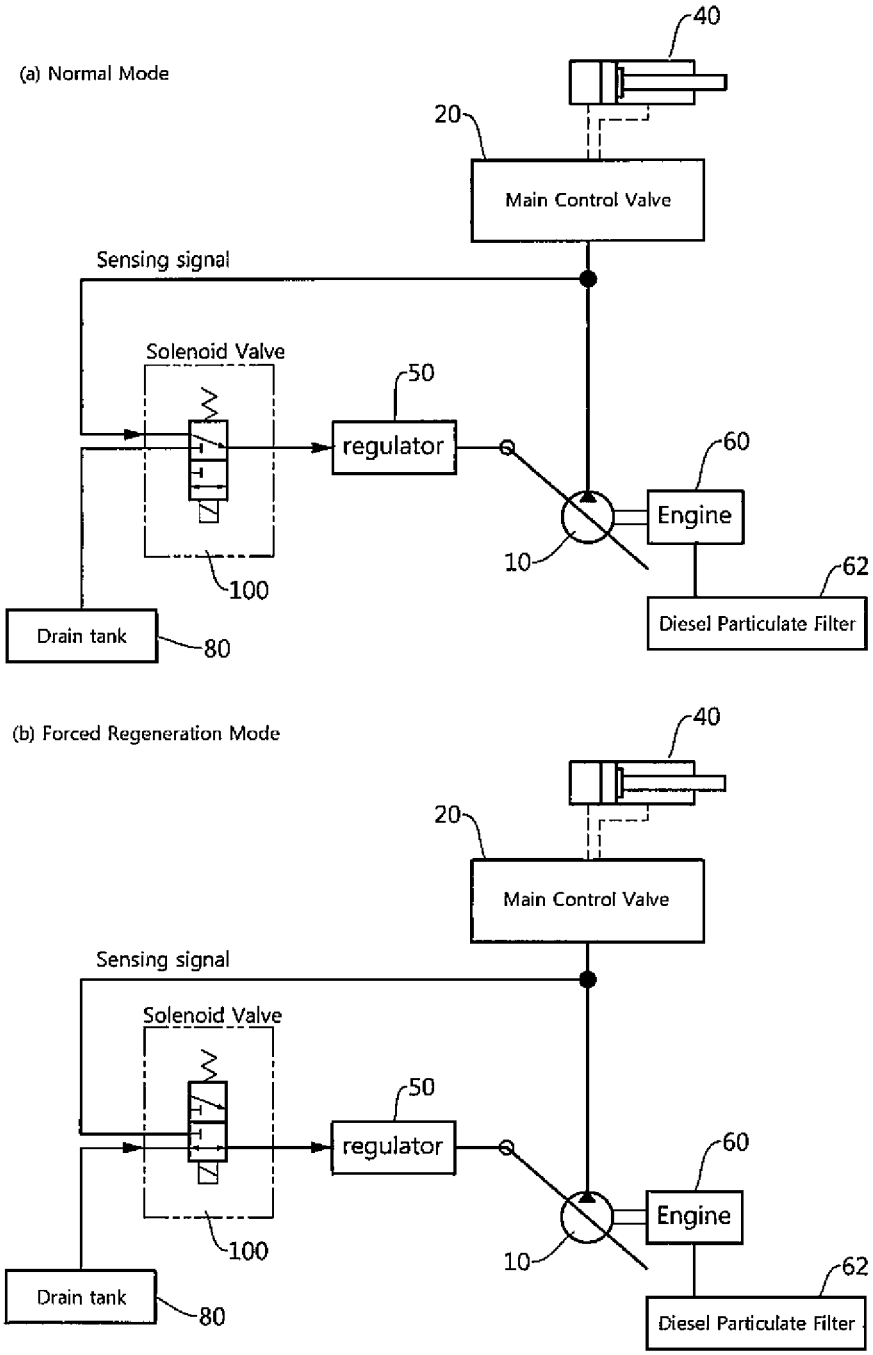

【Fig. 5】
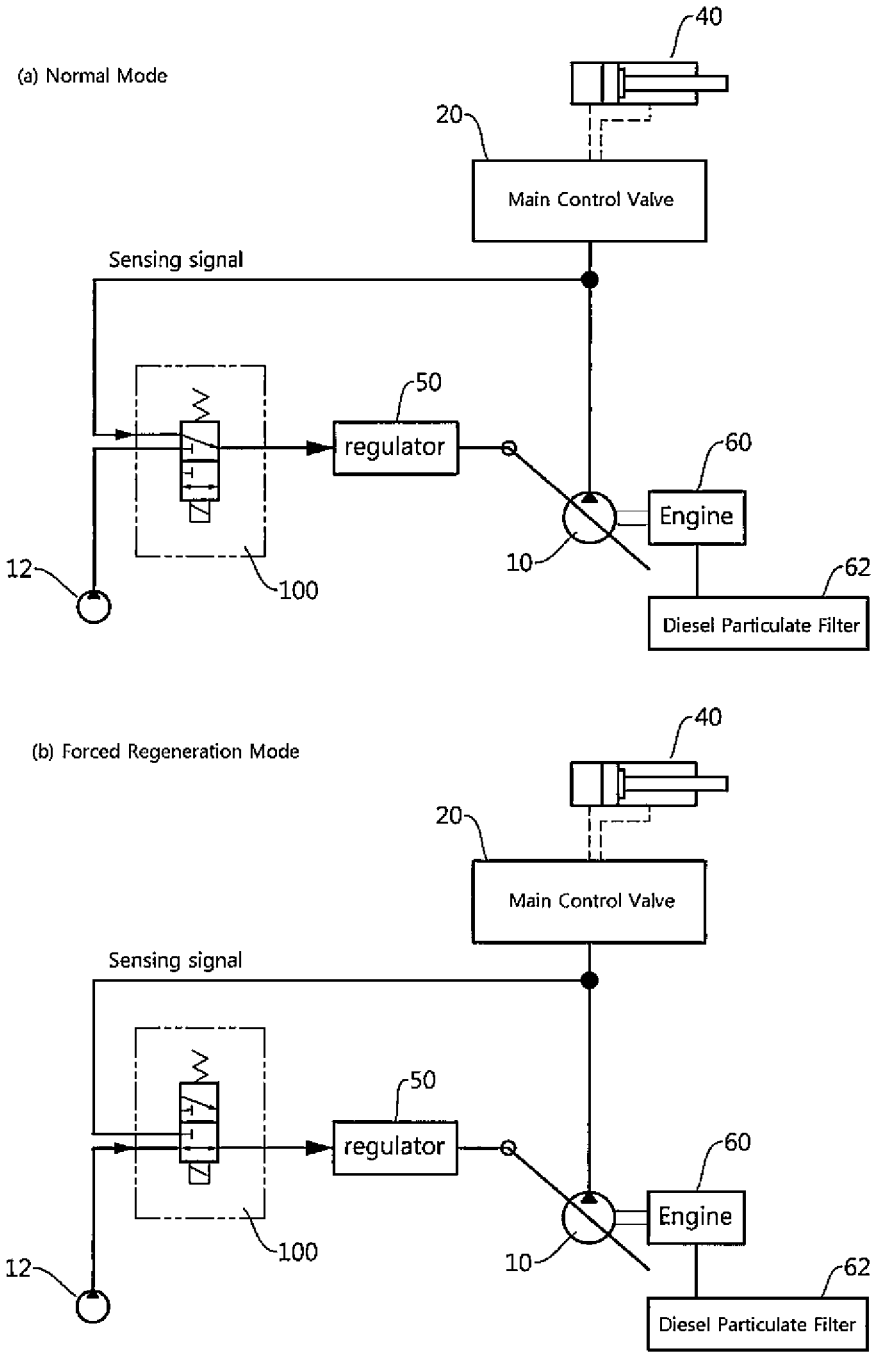

【Fig. 6】
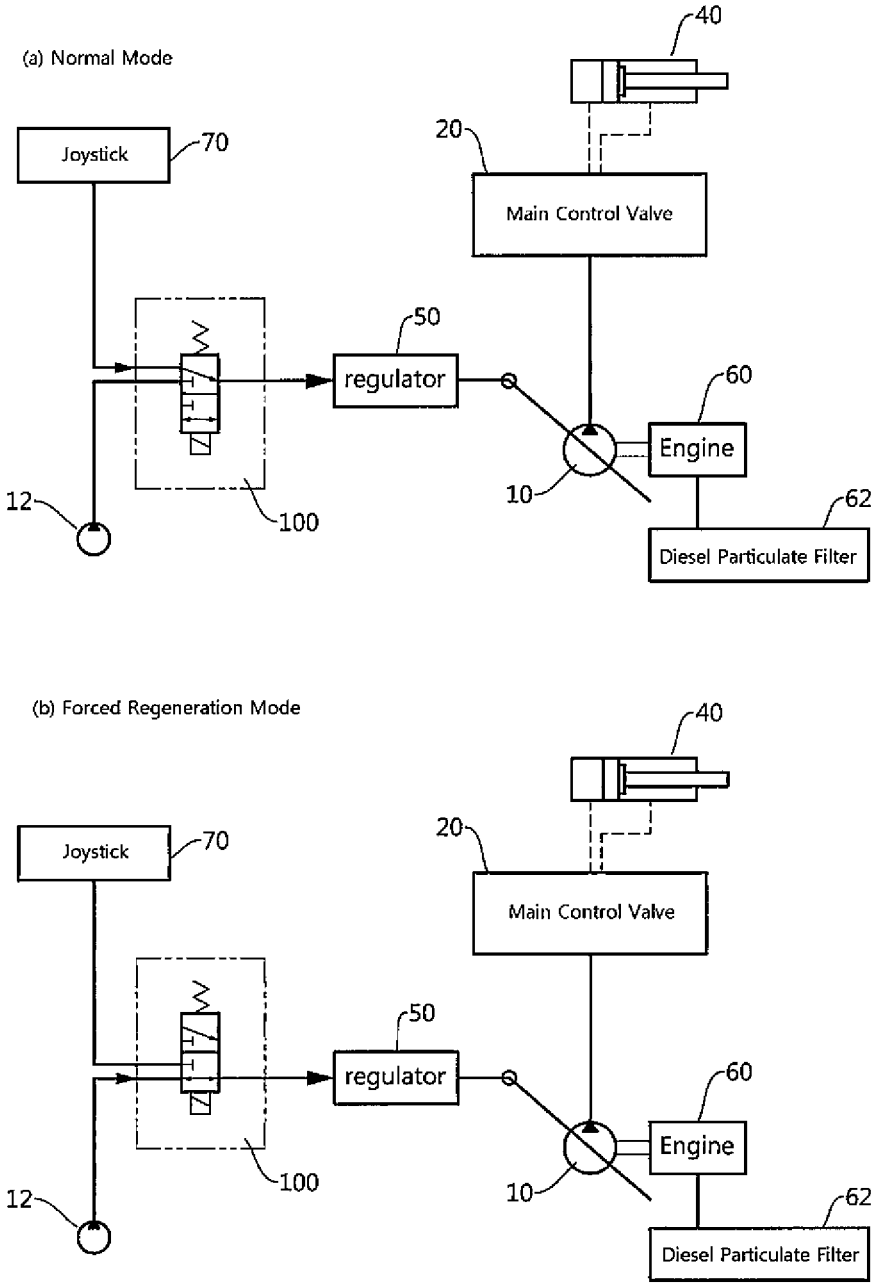

【Fig. 7】
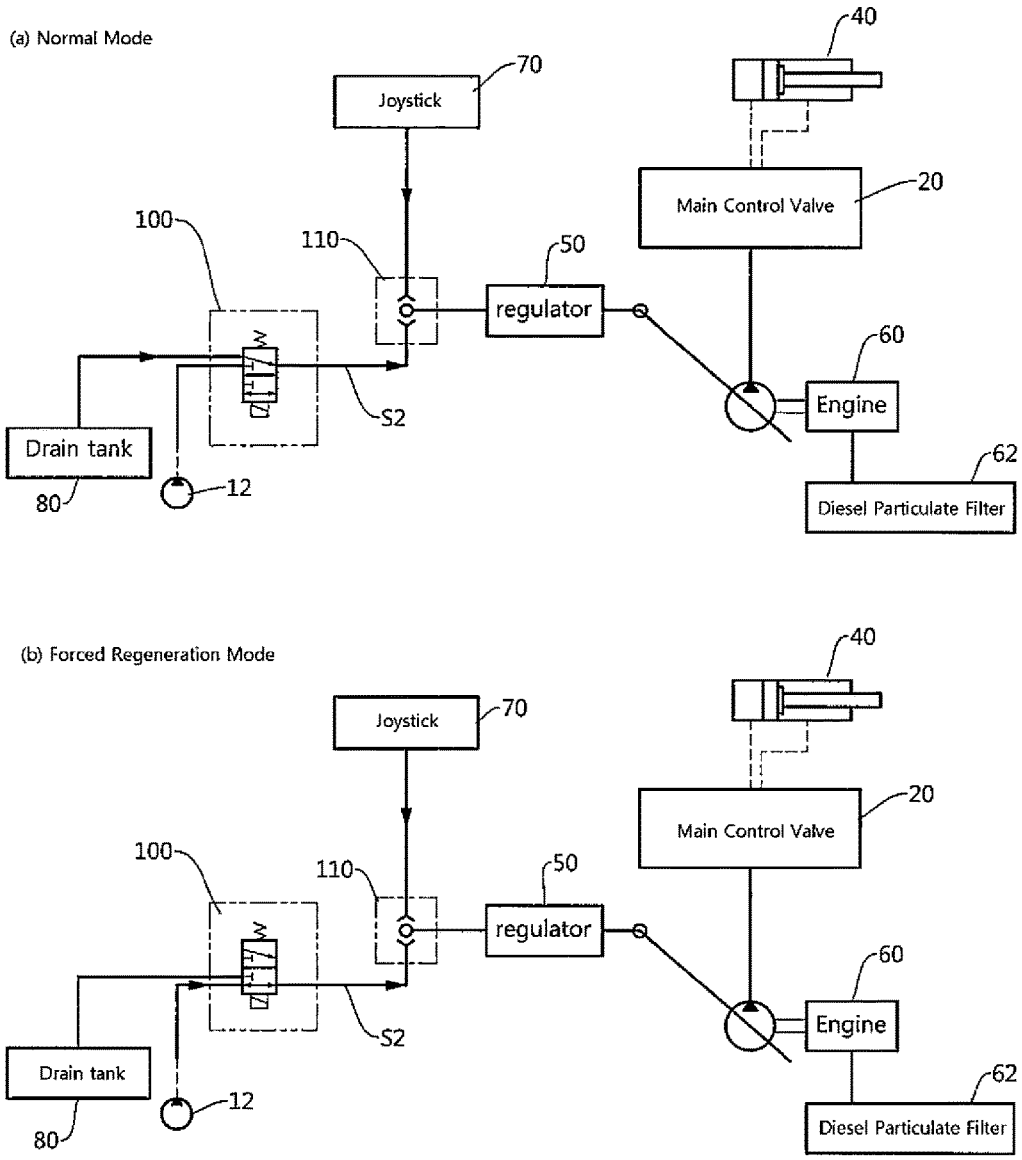

HYDRAULIC CIRCUIT SYSTEM FOR FORCED REGENERATION OF DIESEL PARTICULATE FILTER

CROSS-REFERENCE TO RELATED APPLICATION

This Application is a Section 371 National Stage Application of International Application No. PCT/KR2013/011093, filed Dec. 3, 2013 and published, not in English, as WO 2014/104603 A1 on Jul. 3, 2014.

FIELD OF THE DISCLOSURE

The present disclosure relates to a hydraulic circuit system for forced regeneration of a diesel particulate filter, and more particularly, to a hydraulic circuit system for forced regeneration of a diesel particulate filter (DPF), which prevents a working machine from being operated when the diesel particulate filter is forcedly regenerated by combusting particulate matters (PM) in a case in which the diesel particulate filter is installed in a construction machine with a diesel engine and particulate matters included in exhaust gas are collected in the diesel particulate filter.

BACKGROUND OF THE DISCLOSURE

In general, a diesel particulate filter (DPF) is installed in a construction machine in which a diesel engine is mounted. The diesel particulate filter filters harmful materials included in exhaust gas to prevent environmental air pollution.

Particulate matters (PM) are included in exhaust gas, the particulate matters are collected in the diesel particulate filter, and as a result, performance of the diesel particulate filter deteriorates due to accumulation of the particulate matters, which causes a problem in that exhaust gas cannot be purified.

In order to solve the above problem, the diesel particulate filter oxidizes and removes the accumulated particulate matters through a regeneration process. The regeneration of the diesel particulate filter may be carried out according to a predetermined schedule, may be carried out when a specific condition such as a difference in pressure of exhaust gas is satisfied, or may be carried out when forced regeneration is performed according to a driver's intention.

The regeneration of the diesel particulate filter is carried out by increasing a temperature of exhaust gas to a high temperature in order to oxidize the particulate matters.

To this end, a separate hydraulic load needs to be implemented in the equipment. The reason why the separate hydraulic load is implemented is because only when a temperature at a front end of the diesel particulate filter reaches a predetermined level or higher due to the hydraulic load, the temperature reaches a high temperature through a process of injecting fuel, thereby making it possible to smoothly perform the regeneration.

In the construction machine, a hydraulic pump is driven by power from the engine, the hydraulic pump creates pressure of hydraulic oil and discharges the hydraulic oil, and the hydraulic pump is controlled by a hydraulic circuit system so as to operate a desired particular working machine.

A general hydraulic circuit system of the construction machine will be described in more detail with reference to the attached FIG. 1.

The attached FIG. 1 is a view for explaining a universal hydraulic circuit system of a construction machine.

A diesel particulate filter 62 is provided in a path through which exhaust gas is discharged from an engine 60. In addition, the engine 60 outputs power, and a hydraulic pump 10 is operated by power from the engine 60. The hydraulic pump 10 creates pressure of hydraulic oil and discharges the hydraulic oil, the hydraulic oil is provided to a main control valve 20, and an actuator 40 is connected to the main control valve 20. A bypass cut valve 30 may be provided at a downstream side of the main control valve 20.

Meanwhile, an operating unit such as a joystick is connected to the main control valve 20, for example using a controller 72, a required flow rate/required pressure are formed by an operation of the operating unit, and a signal of the required flow rate is provided to the main control valve 20 for example by the controller 72. A spool of the main control valve 20 is moved by the signal of the required flow rate, and supplies the hydraulic oil to the actuator 40 in a forward direction or a reverse direction or blocks the supply of the hydraulic oil.

The actuator 40 serves to operate the working machine, and when the actuator 40 is not operated, the hydraulic oil discharged from the hydraulic pump 10 is collected in a drain tank 80 sequentially via the main control valve 20 and the bypass cut valve 30.

FIG. 1A may be understood as indicating the hydraulic circuit system in a general situation in which the bypass cut valve 30 is maintained in an opened state, and as a result, the main control valve 20 distributes the hydraulic oil to the actuator 40 corresponding to the particular working machine to perform desired work.

FIG. 1B illustrates a situation when forced regeneration is carried out, and a state in which the bypass cut valve 30 is closed. In a case in which the working machine is not operated, high-pressure hydraulic oil is provided to a front end of the bypass cut valve 30 via the main control valve 20 and then is on standby, and thus the hydraulic oil is not consumed, such that pressure in the lines of the hydraulic circuit system is increased.

In general, the hydraulic load is in proportion to a flow rate and pressure, and the equipment generates heat while consuming energy due to a flow rate and high pressure of the hydraulic oil that flows from the pump to the tank. The hydraulic load generated in the equipment allows a temperature of air at the front end of the diesel particulate filter of the engine to be increased to smoothly perform the regeneration.

Therefore, as the particulate matters PM accumulated in the diesel particulate filter are oxidized, the regeneration of the diesel particulate filter is carried out.

However, the aforementioned hydraulic circuit system in the related art has the following problems.

High pressure is produced in the hydraulic circuit system when the forced regeneration of the diesel particulate filter is carried out, and the high pressure in the hydraulic circuit system may cause a pressure leak from various type of valves, and the leaking pressure is likely to be transmitted to the working machine.

As time passed, a flow rate caused by the pressure leak applies pressure to inlets and outlets of various types of actuators 40 (a boom cylinder, an arm cylinder, and a bucket cylinder). In the case of the boom cylinder and the arm cylinder, a holding valve is mounted in the main control valve (MCV), and as a result, pressure applied to the cylinder is low even though the pressure leak occurs, but because the bucket cylinder does not have a holding valve, high pressure is applied to a cylinder head.

The actuator 40 has a structure in which a piston 42 is inserted into a cylinder 41, and in the case of the cylinder 41, there is a difference in a sectional area between a cylinder head 411 and a cylinder rod 412. That is, even though the same pressure is applied to the cylinder 41, due to the difference in a sectional area, higher pressure is applied in a direction in which a rod of the piston 42 extends, and as a result, the piston 42 is moved toward the rod 412.

Therefore, the working machine may be operated regardless of an operator's intention, and a safety accident may occur due to the unintended operation of the working machine, and therefore, there is a need for a method of preventing the working machine from being operated during the forced regeneration in order to ensure safety.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter.

Therefore, an object of some embodiments of the present disclosure is to provide a hydraulic circuit system for forced regeneration of a diesel particulate filter, which is capable of performing forced regeneration of the diesel particulate filter by producing a hydraulic load in a state in which hydraulic oil is not supplied to a main control valve when forced regeneration of a construction machine is carried out.

In order to solve the above technical problem, a hydraulic circuit system for forced regeneration of a diesel particulate filter according to the present disclosure includes: an engine which generates power; a diesel particulate filter which purifies exhaust gas from the engine; a hydraulic pump which discharges hydraulic oil using the power; a main control valve which is controlled, for example by a controller, to provide the hydraulic oil to an actuator of a working machine; a regulator which adjusts an angle of a swash plate of the hydraulic pump depending on intensity of discharge pressure of the hydraulic oil from the hydraulic pump and controls a discharge flow rate of the hydraulic oil; and a forced regeneration valve which blocks the discharge pressure of the hydraulic oil from being provided to the regulator, and is operated so that the discharge flow rate of the hydraulic oil from the hydraulic pump becomes the maximum, when the diesel particulate filter is in a forced regeneration mode.

In addition, the hydraulic circuit system for forced regeneration of the diesel particulate filter according to the present disclosure may further include: a drain tank which stores the hydraulic oil, in which the forced regeneration valve blocks the discharge pressure of the hydraulic oil from being provided to the regulator, and is operated to connect the drain tank and the regulator, when the diesel particulate filter is in the forced regeneration mode.

In addition, the hydraulic circuit system for forced regeneration of the diesel particulate filter according to the present disclosure may further include: a gear pump which discharges pilot hydraulic oil, in which the forced regeneration valve blocks the discharge pressure of the hydraulic oil from being provided to the regulator, and is operated to provide the pilot hydraulic oil discharged from the gear pump to the regulator, when the diesel particulate filter is in the forced regeneration mode.

In addition, the hydraulic circuit system for forced regeneration of the diesel particulate filter according to the present disclosure may further include: an operating unit which generates a signal of a required flow rate, and controls the regulator depending on a size of the signal of the required flow rate, in which the forced regeneration valve blocks the signal of the required flow rate from being provided to the regulator, and is operated to provide the pilot hydraulic oil discharged from the gear pump to the regulator, when the diesel particulate filter is in the forced regeneration mode.

In addition, the hydraulic circuit system for forced regeneration of the diesel particulate filter according to the present disclosure may further include: a drain tank which stores the hydraulic oil; a gear pump which discharges pilot hydraulic oil; an operating unit which generates a signal of a required flow rate, and controls the regulator depending on a size of the signal of the required flow rate; and a shuttle valve which is operated to provide the regulator with the hydraulic oil at high pressure between the signal of the required flow rate and the pilot hydraulic oil, in which the forced regeneration valve blocks the drain tank and the shuttle valve, and is operated to connect the pilot hydraulic oil discharged from the gear pump with the shuttle valve, when the diesel particulate filter is in the forced regeneration mode.

In addition, in the hydraulic circuit system for forced regeneration of the diesel particulate filter according to the present disclosure, when a plurality of hydraulic pumps is provided, the hydraulic pump may be a hydraulic pump that is not allocated to a bucket cylinder.

Specific items of other exemplary embodiments are included in the detailed description and the drawings.

According to the hydraulic circuit system for forced regeneration of the diesel particulate filter according to the present disclosure, which is configured as described above, it is possible to carry out the forced regeneration of the diesel particulate filter without excessively changing the existing hydraulic circuit system, and it is possible to prevent the working machine from being operated when the forced regeneration of the diesel particulate filter is carried out, thereby preventing a safety accident.

DESCRIPTION OF THE DRAWINGS

FIG. 4 is a view for explaining a hydraulic circuit system for forced regeneration of a diesel particulate filter according to a second exemplary embodiment of the present disclosure, and illustrates a negative control type.

FIG. 5 is a view for explaining a hydraulic circuit system for forced regeneration of a diesel particulate filter according to a third exemplary embodiment of the present disclosure, and illustrates a positive control type.

FIG. 6 is a view for explaining a hydraulic circuit system for forced regeneration of a diesel particulate filter according to a fourth exemplary embodiment of the present disclosure, and illustrates a positive control type.

FIG. 7 is a view for explaining a hydraulic circuit system for forced regeneration of a diesel particulate filter according to a fifth exemplary embodiment of the present disclosure, and illustrates a positive control type.

DESCRIPTION OF MAIN REFERENCE NUMERALS OF THE DRAWINGS

Figure 1:
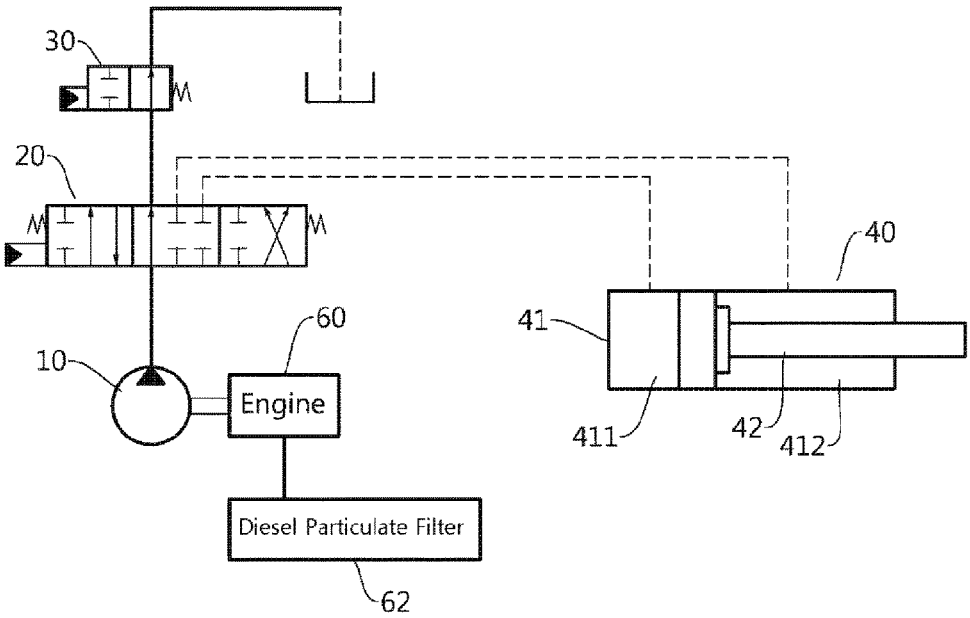
FIGS. 1 and 2 are views for explaining a universal hydraulic circuit system of a construction machine.
Figure 1:
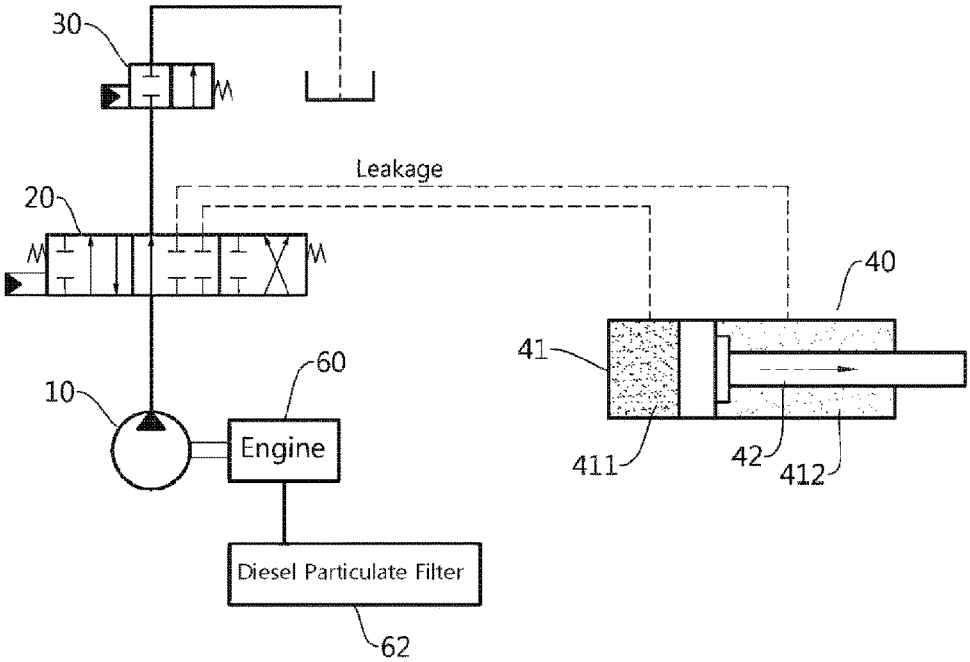
Figure 2:
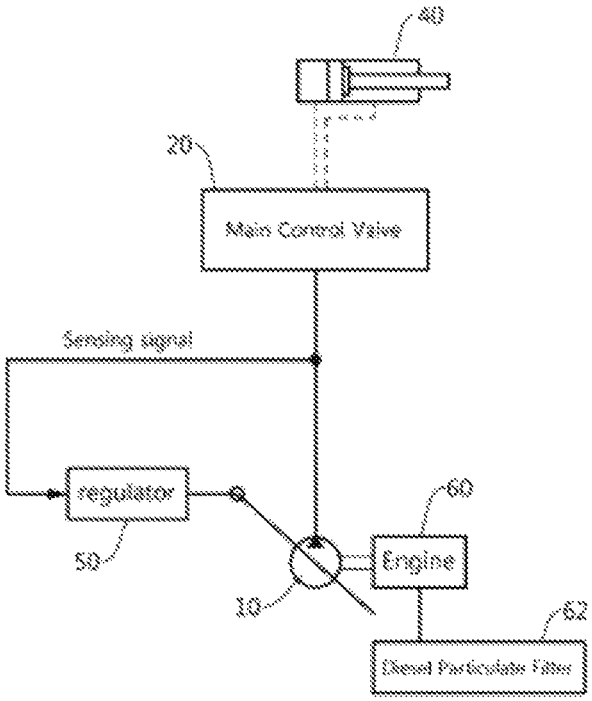

10: Hydraulic pump
12: Gear pump
20: Main control valve
30: Bypass cut valve
40: Actuator
50: Regulator
60: Engine
62: Diesel particulate filter
70: Operating unit
80: Drain tank
100: Forced regeneration control valve
110: Shuttle valve

DETAILED DESCRIPTION

Advantages and features of the present disclosure and methods of achieving the advantages and features will be clear with reference to exemplary embodiments described in detail below together with the accompanying drawings.

Like reference numerals indicate like elements throughout the specification.

Meanwhile, the terms used in the description are defined considering the functions of the present disclosure and may vary depending on the intention or usual practice of a manufacturer. Therefore, the definitions should be made based on the entire contents of the present specification.

Meanwhile, in the related art, a bypass cut valve 30 is controlled to increase hydraulic pressure in order to implement a hydraulic load, but a hydraulic circuit system according to the present disclosure adjusts a flow rate of a pump depending on whether to regenerate a diesel particulate filter. That is, the hydraulic circuit system according to the present disclosure increases a load by increasing a flow rate of the hydraulic pump to the maximum when forced regeneration of the diesel particulate filter is carried out. The present disclosure is advantageous in terms of leakage because lower pressure is applied in a main control valve (MCV) 20 and a discharge flow rate is higher in comparison with the related art.

In particular, since only a flow rate of a pump, which is irrelevant to a bucket cylinder, is adjusted, there is nearly no movement of hydraulic oil applied to the bucket cylinder when the forced regeneration of the diesel particulate filter is carried out, and the movement of the hydraulic oil in this case is equivalent to movement of the hydraulic oil when the regeneration of the diesel particulate filter is not carried out. In detail, in the case of configuring a hydraulic circuit system in a construction machine, a plurality of hydraulic pumps 10 may be provided, and one hydraulic pump and the other hydraulic pump are allocated to spools of a working machine, respectively. For example, a first hydraulic pump may be allocated to a first arm spool, a second boom spool, a swing spool, an optional spool, and a right traveling spool, and a second hydraulic pump may be allocated to a second arm spool, a first boom spool, a bucket spool, and a left traveling spool. The hydraulic circuit system according to the exemplary embodiment of the present disclosure serves to control the first hydraulic pump.

The control type of the hydraulic circuit of the construction machine is classified into a negative control type and a positive control type. The present disclosure discloses a technology that can be applied to both of the two types, and the hydraulic circuit system for forced regeneration of the diesel particulate filter according to the exemplary embodiment of the present disclosure will be described with reference to the attached FIGS. 3 to 7 as exemplary embodiments.

First Exemplary Embodiment

Figure 3:
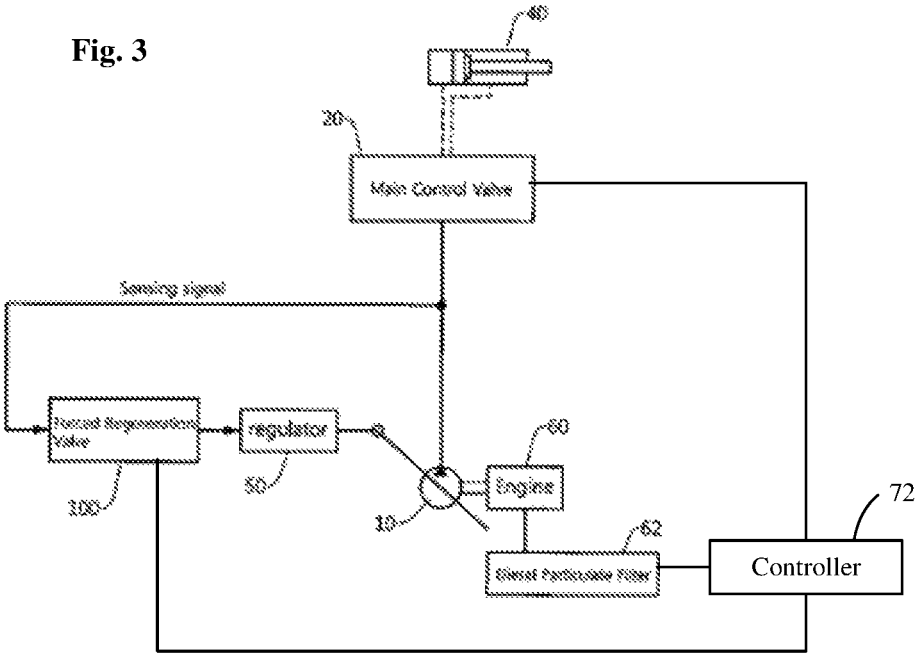
FIG. 3 is a view for explaining a hydraulic circuit system for forced regeneration of a diesel particulate filter according to a first exemplary embodiment of the present disclosure, and illustrates a negative control type.

As illustrated in FIG. 3, in the case of a hydraulic circuit system according to a first exemplary embodiment of the present disclosure, power is generated by an engine 60, and a diesel particulate filter 62, which purifies exhaust gas, is provided in a path through which exhaust gas is discharged from the engine 60.

The power generated by the engine 60 operates a hydraulic pump 10, and the hydraulic pump 10 discharges pressurized hydraulic oil.

The hydraulic oil is provided to a main control valve 20 and is on standby, and an actuator 40 associated with a particular spool is operated by an operation of the corresponding spool.

Meanwhile, a swash plate is provided in the hydraulic pump 10, and a discharge flow rate of the hydraulic oil is increased or decreased depending on an inclination angle of the swash plate. The inclination angle of the swash plate is controlled by a regulator 50. That is, the angle of the swash plate of the hydraulic pump 10 is adjusted depending on the intensity of discharge pressure of the hydraulic oil of the hydraulic pump 10.

Meanwhile, a forced regeneration valve 100, under control of controller 72, is further provided in a hydraulic line through which the discharge pressure of the hydraulic oil is provided from the hydraulic pump 10 to the regulator 50.

When the diesel particulate filter 62 is in a forced regeneration mode controlled by controller 72, the forced regeneration valve 100 under control of controller 72 blocks the discharge pressure of the hydraulic oil from being provided to the regulator 50, and is operated so that the discharge flow rate of the hydraulic oil from the hydraulic pump 10 becomes the maximum.

Therefore, a load pressure of the hydraulic pump 10 may be produced by the regulator 50 by controlling the forced regeneration valve 100, and various types of spools provided in the main control valve 20 are, under control of controller 72, not operated, thereby preventing the working machine from being abnormally operated.

Second Exemplary Embodiment

The attached FIG. 4 is a view for explaining a hydraulic circuit system for forced regeneration of a diesel particulate filter according to a second exemplary embodiment of the present disclosure, and illustrates a negative control type. In more detail, FIG. 4A illustrates a configuration of the hydraulic circuit system when general work is carried out, and FIG. 4B illustrates a configuration of the hydraulic circuit system when forced regeneration of the diesel particulate filter is carried out.

As illustrated in FIG. 4, hydraulic oil discharged from a hydraulic pump 10 is provided to a main control valve 20, and the hydraulic pump 10 is connected to an engine 60 and receives power. Discharge pressure of the hydraulic oil is produced between control lines of the main control valve 20 and the hydraulic pump 10. The discharge pressure controls a regulator 50, and the regulator 50 adjusts an angle of a swash plate of the hydraulic pump 10. That is, in a case in which a required flow rate is increased as the working machine performs work, the hydraulic pump 10 is variably adjusted to increase or decrease the discharge flow rate in proportion to the increase in discharge pressure by providing the regulator 50 with the discharge pressure of the hydraulic oil, which is provided to the main control valve 20.

A forced regeneration control valve 100 is provided in a pressure line through which the discharge pressure is provided to the regulator 50. The forced regeneration control valve 100 is opened in a normal mode, and closed in a forced regeneration mode.

In addition, in a case in which the forced regeneration control valve 100 is closed, a drain tank 80 and the regulator 50 are connected.

That is, as illustrated in FIG. 4A, in a case in which the regeneration of the diesel particulate filter is not carried out and general work is carried out, the forced regeneration control valve 100 is opened to allow the hydraulic oil to be discharged from the hydraulic pump 10 at a flow rate in proportion to the discharge pressure.

In contrast, as illustrated in FIG. 4B, when the regeneration of the diesel particulate filter is intended to be carried out, the forced regeneration control valve 100 is closed, and the hydraulic pump is connected with the drain tank 80, such that low pressure is applied to the hydraulic pump. In the case of the negative control type, since the hydraulic oil is discharged at a maximum flow rate when pressure applied to the hydraulic pump 10 becomes low, the hydraulic pump 10 is controlled to discharge the hydraulic oil at a maximum flow rate, such that a load of the equipment is increased, a temperature of the exhaust gas is increased, and as a result, the regeneration of the diesel particulate filter is carried out.

Therefore, lower pressure is applied in the main control valve (MCV) 20 and the discharge flow rate is higher in comparison with the hydraulic circuit system in the related art, such that a pressure leak caused by high pressure does not occur, and as a result, it is possible to prevent the working machine from being operated by the pressure leak. In addition, in a case in which a plurality of hydraulic pumps is provided, the hydraulic pump 10 does not operate a bucket cylinder. Therefore, there is no concern that the maximum discharge flow rate will affect the bucket cylinder.

Third Exemplary Embodiment

FIG. 5 is a view for explaining a hydraulic circuit system for forced regeneration of a diesel particulate filter according to a third exemplary embodiment of the present disclosure, and illustrates a positive control type. In more detail, FIG. 5A illustrates a configuration of the hydraulic circuit system when general work is carried out, and FIG. 5B illustrates a configuration of the hydraulic circuit system when forced regeneration of the diesel particulate filter is carried out.

As illustrated in FIG. 5, hydraulic oil discharged from a hydraulic pump 10 is provided to a main control valve 20, and the hydraulic pump 10 is connected to an engine 60 and receives power. Discharge pressure of the hydraulic oil is produced between control lines of the main control valve 20 and the hydraulic pump 10. The discharge pressure controls a regulator 50, and the regulator 50 adjusts an angle of a swash plate of the hydraulic pump 10. That is, in a case in which a required flow rate is increased as the working machine performs work, the hydraulic pump 10 is variably adjusted to increase or decrease the discharge flow rate in proportion to the increase in discharge pressure by providing the regulator 50 with the discharge pressure of the hydraulic oil, which is provided to the main control valve 20.

A forced regeneration control valve 100 is provided in a pressure line through which the discharge pressure is provided to the regulator 50. A gear pump 12, which discharges pilot hydraulic oil, is further provided at one side of the forced regeneration control valve 100.

The forced regeneration control valve 100 is opened in a normal mode, and closed in a forced regeneration mode.

In addition, in a case in which the forced regeneration control valve 100 is closed, the gear pump 12 and the regulator 50 are connected so that the pilot hydraulic oil is provided to the regulator 50.

In the hydraulic circuit system of the positive control type, the hydraulic pump 10 discharges the hydraulic oil at a maximum flow rate by fixed pressure provided from the gear pump 12, a load of the equipment is increased, and a temperature of exhaust gas is increased.

Therefore, lower pressure is applied in the main control valve (MCV) 20 and the discharge flow rate is higher in comparison with the hydraulic circuit system in the related art, such that a pressure leak caused by high pressure does not occur, and as a result, it is possible to prevent the working machine from being operated by the pressure leak. In addition, in a case in which a plurality of hydraulic pumps is provided, the hydraulic pump 10 does not operate a bucket cylinder. Therefore, there is no concern that the maximum discharge flow rate will affect the bucket cylinder.

Fourth Exemplary Embodiment

FIG. 6 is a view for explaining a hydraulic circuit system for forced regeneration of a diesel particulate filter according to a fourth exemplary embodiment of the present disclosure, and illustrates a positive control type. In more detail, FIG. 6A illustrates a configuration of the hydraulic circuit system when general work is carried out, and FIG. 6B illustrates a configuration of the hydraulic circuit system when forced regeneration of the diesel particulate filter is carried out.

As illustrated in FIG. 6, hydraulic oil discharged from a hydraulic pump 10 is provided to a main control valve 20, and the hydraulic pump 10 is connected to an engine 60 and receives power. Meanwhile, a signal of a required flow rate is generated by an operating unit 70. The signal of the required flow rate controls a regulator 50, and the regulator 50 adjusts an angle of a swash plate of the hydraulic pump 10. That is, in a case in which a required flow rate is increased by the operating unit 70, the hydraulic pump 10 is variably adjusted to increase or decrease the discharge flow rate in proportion to the signal of the required flow rate by providing the signal of the required flow rate to the regulator 50.

A forced regeneration control valve 100 is provided in a pressure line through which the signal of required pressure is provided to the regulator 50. A gear pump 12, which discharges pilot hydraulic oil, is further provided at one side of the forced regeneration control valve 100.

The forced regeneration control valve 100 is opened in a normal mode such that the signal of the required flow rate is provided to the regulator 50, and the forced regeneration control valve 100 is closed in a forced regeneration mode.

In addition, in a case in which the forced regeneration control valve 100 is closed, the gear pump 12 and the regulator 50 are connected so that the pilot hydraulic oil is provided to the regulator 50.

In the hydraulic circuit system of the positive control type, the hydraulic pump 10 discharges the hydraulic oil at a maximum flow rate by fixed pressure provided from the gear pump 12, a load of the equipment is increased, and a temperature of exhaust gas is increased.

Therefore, lower pressure is applied in the main control valve (MCV) 20 and the discharge flow rate is higher in comparison with the hydraulic circuit system in the related art, such that a pressure leak caused by high pressure does not occur, and as a result, it is possible to prevent the working machine from being operated by the pressure leak. In addition, in a case in which a plurality of hydraulic pumps is provided, the hydraulic pump 10 does not operate a bucket cylinder. Therefore, there is no concern that the maximum discharge flow rate will affect the bucket cylinder.

Fifth Exemplary Embodiment

FIG. 7 is a view for explaining a hydraulic circuit system for forced regeneration of a diesel particulate filter according to a fifth exemplary embodiment of the present disclosure, and illustrates a positive control type. In more detail, FIG. 7A illustrates a configuration of the hydraulic circuit system when general work is carried out, and FIG. 7B illustrates a configuration of the hydraulic circuit system when forced regeneration of the diesel particulate filter is carried out.

As illustrated in FIG. 7, hydraulic oil discharged from a hydraulic pump 10 is provided to a main control valve 20, and the hydraulic pump 10 is connected to an engine 60 and receives power. Meanwhile, a signal of a required flow rate is generated by an operating unit 70. The signal of the required flow rate controls a regulator 50, and the regulator 50 adjusts an angle of a swash plate of the hydraulic pump 10. That is, in a case in which a required flow rate is increased by the operating unit 70, the hydraulic pump 10 is variably adjusted to increase or decrease the discharge flow rate in proportion to the signal of the required flow rate by providing the signal of the required flow rate to the regulator 50.

A shuttle valve 110 is provided in a pressure line through which the signal of required pressure is provided to the regulator 50. The other side of the shuttle valve 110 is connected with a forced regeneration control valve 100. A gear pump 12, which discharges pilot hydraulic oil, and a drain tank 80, which stores the hydraulic oil, are connected with the other side of the forced regeneration control valve 100.

The forced regeneration control valve 100 connects the drain tank 80 and the shuttle valve 110 in a normal mode, and connects the gear pump 12 and the shuttle valve 110 in a forced regeneration mode.

Meanwhile, in the normal mode, the drain tank 80 and the shuttle valve 110 are connected such that atmospheric pressure is substantially applied to the shuttle valve 110, and the signal of the required flow rate provided from the operating unit 70 is higher than atmospheric pressure, such that a signal of required pressure is selected by the shuttle valve 110. That is, the signal of the required flow rate is provided to the regulator 50.

On the other hand, in the forced regeneration mode, the gear pump 12 and the regulator 50 are connected such that pressure of the pilot hydraulic oil is applied to the shuttle valve 110. The signal of the required flow rate is not generated by the operating unit 70 while the forced regeneration is carried out, and as a result, the pilot hydraulic oil, which is discharged from the gear pump 12, is selected by the shuttle valve 110. That is, in the forced regeneration mode, the pilot hydraulic oil is provided from the gear pump 12 to the regulator 50.

That is, in the hydraulic circuit system of the positive control type, the hydraulic pump 10 discharges the hydraulic oil at a maximum flow rate by fixed pressure provided from the gear pump 12, a load of the equipment is increased, and a temperature of exhaust gas is increased.

Therefore, lower pressure is applied in the main control valve (MCV) 20 and the discharge flow rate is higher in comparison with the hydraulic circuit system in the related art, such that a pressure leak caused by high pressure does not occur, and as a result, it is possible to prevent the working machine from being operated by the pressure leak. In addition, in a case in which a plurality of hydraulic pumps is provided, the hydraulic pump 10 does not operate a bucket cylinder. Therefore, there is no concern that the maximum discharge flow rate will affect the bucket cylinder.

Meanwhile, the hydraulic circuit systems according to the third and fourth exemplary embodiments of the present disclosure are advantageous in that costs are reduced in view of the configuration of the hydraulic circuit system compared with the hydraulic circuit system according to the fifth exemplary embodiment because the shuttle valve 110 is omitted. In addition, according to the hydraulic circuit systems according to the first, second, third, fourth and fifth exemplary embodiments of the present disclosure, the hydraulic pump 10 does not operate the bucket cylinder in a case in which a plurality of hydraulic pumps is provided. Therefore, there is no concern that the maximum discharge flow rate will affect the bucket cylinder.

The exemplary embodiments of the present disclosure have been described with reference to the accompanying drawings, but those skilled in the art will understand that the present disclosure may be implemented in any other specific form without changing the technical spirit or an essential feature thereof.

Accordingly, it should be understood that the aforementioned exemplary embodiment is described for illustration in all aspects and are not limited, and the scope of the present disclosure shall be represented by the claims to be described below, and it should be construed that all of the changes or modified forms induced from the meaning and the scope of the claims, and an equivalent concept thereto are included in the scope of the present disclosure.

The hydraulic circuit system according to the present disclosure may be used to prevent the working machine from being operated when the forced regeneration of the diesel particulate filter is carried out.

The invention claimed is:

1. A hydraulic circuit system for forced regeneration of a diesel particulate filter, the hydraulic circuit system comprising:

an engine configured to generate power;

a diesel particulate filter provided in a path through which exhaust gas is discharged from the engine, and configured to purify the exhaust gas from the engine;

a hydraulic pump connected to the engine, and configured to discharge hydraulic oil using the power of the engine;

a main control valve including a spool, the main control valve is directly connected to the hydraulic pump via a hydraulic oil conduit and provided between the hydraulic pump and an actuator of a working machine, wherein the main control valve is configured to provide the hydraulic oil to the actuator of the working machine;

a regulator connected to the hydraulic pump, and configured to adjust an angle of a swash plate of the hydraulic pump based on an intensity of discharge pressure of the hydraulic oil from the hydraulic pump in order to control a discharge flow rate of the hydraulic oil from the hydraulic pump;

a hydraulic line directly connected to the hydraulic oil conduit and configured to provide the discharge pressure of the hydraulic oil from the hydraulic pump to the regulator; and a forced regeneration valve provided in the hydraulic line, and configured to block, in a forced regeneration mode, the discharge pressure of the hydraulic oil provided to the regulator so that the discharge flow rate of the hydraulic oil from the hydraulic pump becomes the maximum.

2. The hydraulic circuit system of claim 1, further comprising:

a drain tank which stores the hydraulic oil, wherein in a normal mode, the forced regeneration valve blocks the discharge pressure of the hydraulic oil from being provided to the regulator and in the forced regeneration mode, the forced regeneration valve is operated to connect the drain tank and the regulator, when the diesel particulate filter is in the forced regeneration mode.

3. The hydraulic circuit system of claim 1, further comprising:

a gear pump which discharges pilot hydraulic oil, wherein in a normal mode, the forced regeneration valve blocks the discharge pressure of the hydraulic oil from being provided to the regulator and in the forced regeneration mode, the forced regeneration valve is operated to provide the pilot hydraulic oil discharged from the gear pump to the regulator, when the diesel particulate filter is in the forced regeneration mode.

4. The hydraulic circuit system of claim 1, wherein the hydraulic pump is not allocated to a bucket cylinder.

* * * * *